US008931226B2

(12) United States Patent
Thorton

(10) Patent No.: US 8,931,226 B2
(45) Date of Patent: Jan. 13, 2015

(54) SHOCK-ABSORBING PREFABRICATED WOOD FLOORING

(75) Inventor: William Thorton, Arlington Heights, IL (US)

(73) Assignee: Tarkett GDL S.A., Lentzweiler (LU)

( * ) Notice: Subject to any disclaimer, the term of this patent is extended or adjusted under 35 U.S.C. 154(b) by 3 days.

(21) Appl. No.: 13/698,203

(22) PCT Filed: Jan. 27, 2011

(86) PCT No.: PCT/EP2011/051176
§ 371 (c)(1),
(2), (4) Date: Jan. 8, 2013

(87) PCT Pub. No.: WO2011/144362
PCT Pub. Date: Nov. 24, 2011

(65) Prior Publication Data

US 2013/0104479 A1 May 2, 2013

Related U.S. Application Data

(60) Provisional application No. 61/345,262, filed on May 17, 2010.

(51) Int. Cl.
*E04F 15/22* (2006.01)

(52) U.S. Cl.
CPC ..... *E04F 15/22* (2013.01); *E04F 15/225* (2013.01)
USPC ..... 52/403.1; 52/390; 52/462

(58) Field of Classification Search
CPC ..... E04F 15/22; E04F 15/225
USPC ..... 52/309.3, 390, 403.1, 408, 413, 480, 52/541, 578, 462, 463, 468, 469, 591.3, 52/591.4
See application file for complete search history.

(56) References Cited

U.S. PATENT DOCUMENTS

| | | | | | |
|---|---|---|---|---|---|
| 1,789,576 | A | * | 1/1931 | Bowman | 52/403.1 |
| 2,367,318 | A | * | 1/1945 | Tulloch, Jr. | 52/541 |
| 2,823,427 | A | * | 2/1958 | Kuhlman | 52/480 |
| 4,694,627 | A | * | 9/1987 | Omholt | 52/390 |
| 5,103,614 | A | * | 4/1992 | Kawaguchi et al. | 52/403.1 |
| 5,253,464 | A | * | 10/1993 | Nilsen | 52/480 |
| 7,703,252 | B2 | * | 4/2010 | Randjelovic | 52/403.1 |
| 2002/0189184 | A1 | | 12/2002 | Shelton | |
| 2009/0084054 | A1 | | 4/2009 | Randjelovic et al. | |
| 2009/0211192 | A1 | | 8/2009 | Valentine | |

FOREIGN PATENT DOCUMENTS

| | | | |
|---|---|---|---|
| DE | 37 27 152 | A1 | 2/1988 |
| DE | 38 38 733 | A1 | 5/1990 |
| DE | 295 15 021 | U1 | 11/1995 |
| EP | 565 082 | A2 | 10/1993 |
| FR | 1 597 611 | A | 6/1970 |

* cited by examiner

*Primary Examiner* — Mark Wendell
*Assistant Examiner* — Matthew J Smith
(74) *Attorney, Agent, or Firm* — Reinhart Boerner Van Deuren P.C.

(57) ABSTRACT

The present invention relates to a shock absorbing base flooring section comprising a primary deck comprising interconnection means to interconnect at least two base flooring sections and comprising shock absorption means attached under said primary deck, a subfloor attached under said primary deck and provided adjacent to the shock absorbing means, the subfloor having a thickness lower than the height of said shock absorption means.

13 Claims, 11 Drawing Sheets

SHOCK-ABSORBING PREFABRICATED WOOD FLOORING

FIELD OF THE INVENTION

The present invention relates to a shock absorbing base flooring for prefabricated flooring system and to a prefabricated flooring system comprising such a base flooring.

PRIOR ART AND RELATED TECHNICAL BACKGROUND

It is well known that areas used for indoor sports are generally covered by synthetic material or by wood inlaid flooring to provide a surface with suitable properties for players and sportsmen, in particular with suitable rebounding or shock-absorbing properties.

Shock-absorbing properties are typically obtained by implementing on the flooring system shock absorption devices such as, for example, the resilient pads described in U.S. Pat. No. 5,682,724 which include a resilient inner element and an outer element which surrounds the inner element. The outer element is made of a material which is of higher durometer than the inner element, and is lower in profile than the inner element. Preferably the outer element is non-resilient. Under normal loads applied to the floor, the softer inner element contacts the substrate, resulting in desirable floor response characteristics. Under heavy loading, the harder outer element comes into contact with the substrate, thus supporting the floor and preventing damage to the inner element.

US 2009211192 discloses a shock absorber for a sports floor assembly having a base portion and a truncated pyramid portion. The base portion is formed of an elastomeric material and is connectable to a sub-flooring of the floor assembly with the second side positioned adjacent to the sub-flooring. The pyramid portion extends from the first side of the base portion. The pyramid portion is formed of an elastomeric material and has stepped sides.

However, the wood floorings of the prior art have a number of drawbacks. They are generally difficult to install. They have several moving parts leading to dysfunctions of the overall system. They may fatigue over time and are noisy, the noise being created from various components whether intended to be fixed or moving found within the systems. Furthermore, they are less dimensionally stable and generally do not offer a uniformity of game play.

AIMS OF THE INVENTION

The present invention aims to provide a base flooring section for prefabricated flooring system, and a prefabricated wood flooring system, which do not have the drawbacks of the prior art.

The present invention aims to provide a base flooring section for prefabricated wood flooring system, a base flooring and a prefabricated wood flooring system, that are an alternative to existing systems.

The invention aims to provide a base flooring section for prefabricated wood flooring system, and a prefabricated wood flooring system, having improved performances, for example in terms of shock absorption, vertical deformation, ball bounce, rolling loads, area deflection and load bearing.

The invention aims to provide a base flooring section for prefabricated wood flooring system, and a prefabricated wood flooring system, being easy to install and having reduced costs of fabrication.

SUMMARY OF THE INVENTION

The present invention relates to a shock absorbing base flooring section comprising a primary deck comprising an upper side and an under side, said primary deck comprising interconnection means to interconnect at least two base flooring sections arranged above said upper side and comprising shock absorption means attached under said under side, a subfloor, attached under said under side of said primary deck and provided adjacent to the shock absorbing means, said subfloor having a thickness lower than the height (L10) of said shock absorption means.

According to particular embodiments, the shock absorbing base flooring section may comprise one, or a combination of any, of the following characteristics:

- the shock absorbing base flooring section further comprises resilient means embedded in, extending outwardly and downwardly from, the subfloor, the absorption means and said resilient means being arranged to contact simultaneously, in use, a surface to cover in the same plane,
- the resilient means are arranged into a downwardly facing continuous channel,
- the subfloor is made a two panels running along the length of the primary deck and between three series of shock absorbing means, the first and second series being provided at two opposite edges of said primary deck and the third series being provided in the middle portion of said primary deck,
- the shock absorption means comprise a plurality of pads aligned and periodically spaced along the length of the primary deck in a plurality of parallel rows, two of said rows arranged at two opposite edges of said primary deck and two rows arranged in the middle portion of said primary deck,
- the pads have a hardness comprised between 45 and 70 durometer,
- the shock absorption means comprise a least one foam provided along the length and both sides of the subfloor,
- the shock absorbing base flooring section further comprises anchoring means to affix said base flooring section (1) to the surface to cover,
- the interconnection means comprise a first and a second nailing strip and at a first and second opposite edges of the primary deck, the first nailing strip extending backward and above said first edge to form a joint portion, the second nailing strip extending outwardly beyond and above said second edge to form a joint portion, both joint portions being cooperative to each other,
- the interconnection means comprise a third nailing strip arranged above and substantially at the centre of the primary deck and extending outwardly beyond and above a third edge and extending backward and above a fourth edge, opposite to third edge of said primary deck to form cooperative joint portions,
- the shock absorbing base flooring section is made of wood.

The present invention relates also to a prefabricated flooring system comprising at least two interconnected shock absorbing base flooring sections according to the invention and an upper flooring.

In a preferred embodiment, the prefabricated flooring system is a sport flooring.

SHORT DESCRIPTION OF THE DRAWINGS

DETAILED DESCRIPTION OF THE INVENTION

Figure 1:
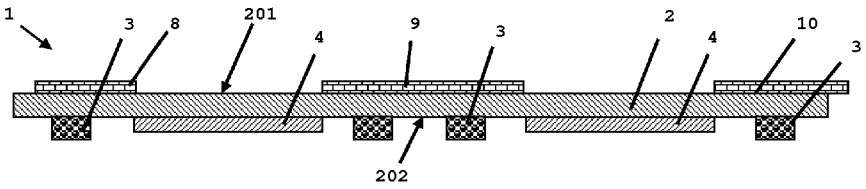
FIG. 1 represents schematically a first embodiment of the base flooring section according to the invention.

The shock absorbing base flooring section 1 according to the invention has any suitable shape, preferably a square or rectangular shape and comprises a primary deck 2 comprising an upper side 201 and an under side 202, shock absorption means 3 and a subfloor 4 arranged under the primary deck 2.

The primary deck 2 is a one piece panel, preferably made of wood, and having any suitable thickness L7. In a preferred embodiment, it is a 48 inches (1.22 m) by 96 inches (2.44 m) and 15/32 inch (11 mm) thick plywood panel.

The shock absorption means 3 of the primary deck 2 comprise at least one device, more preferably a plurality of devices, made of any suitable resilient material and having any suitable profile (FIGS. 1 to 6). The shock absorption means 3, having a height (L10), are provided under the primary deck 2 and are running continuous down the length, and on both sides, of the subfloor 4.

Once the base flooring section 1 is installed onto the surface to cover, concrete or slab, and in normal use of the floor system comprising the base flooring section 1, only the shock absorption means 3 engage, and are in contact with, the surface to cover.

Figure 2:
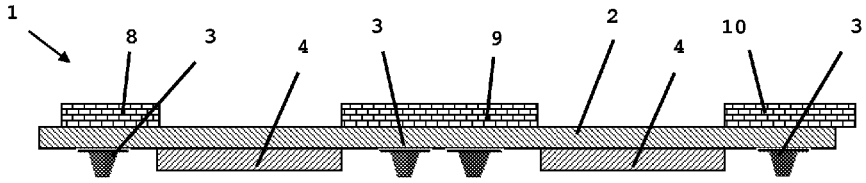
FIG. 2 represents schematically a second embodiment of the base flooring section according to the invention.
Figure 3:
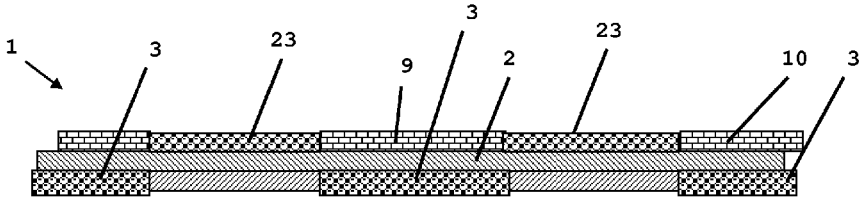
FIG. 3 represents schematically a third embodiment of the base flooring section according to the invention.
Figure 4:
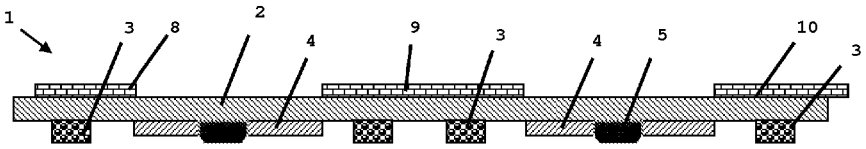
FIG. 4 represents schematically a fourth embodiment of the base flooring section according to the invention.
Figure 5:
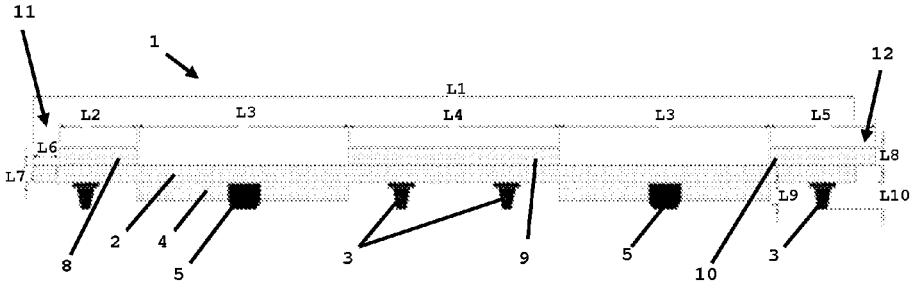
FIG. 5 represents schematically a fifth embodiment of the base flooring section according to the invention.

The shock absorption means 3 have any suitable form. In a first embodiment, the shock absorption means 3 comprise a pad, or a plurality of pads periodically spaced and having substantially a uniform cross-sectional geometry. Preferably, said pads present a square cross section (FIGS. 1 and 4), or more preferably a truncated cone cross section (FIGS. 2 and 5). They have any suitable height to engage the surface to cover in normal use without allowing the subfloor to engage the surface to cover. Therefore, they have a height higher than the height or thickness of the subfloor 4.

Figure 7:
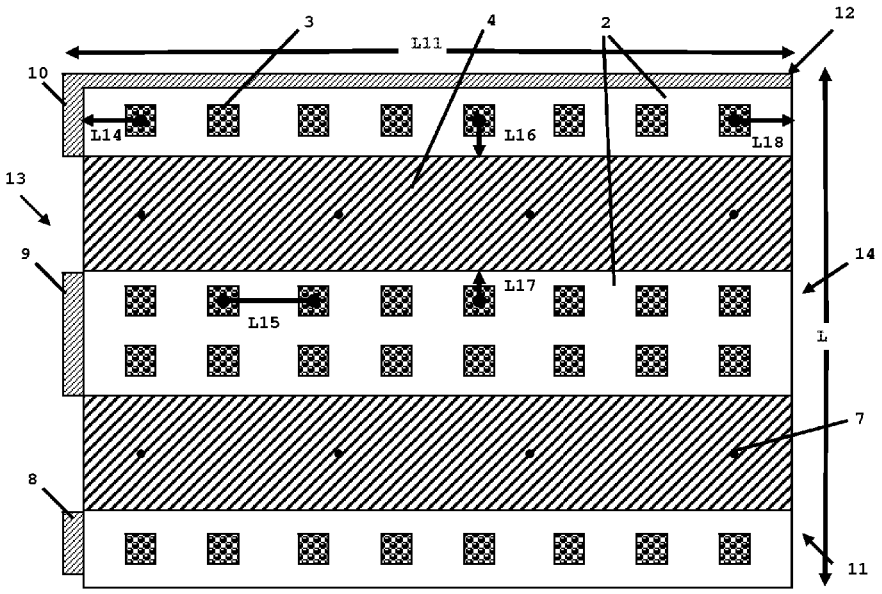
FIG. 7 represents schematically an underside view of the first embodiment of base flooring section represented in FIG. 1.
Figure 8:
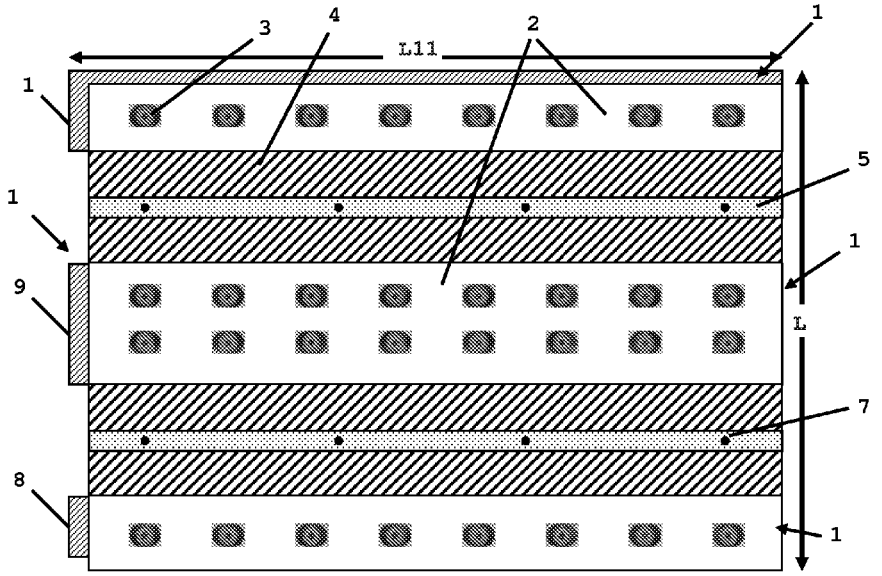
FIG. 8 represents schematically an underside view of the fifth embodiment of the base flooring section represented in FIG. 5.
Figure 9:
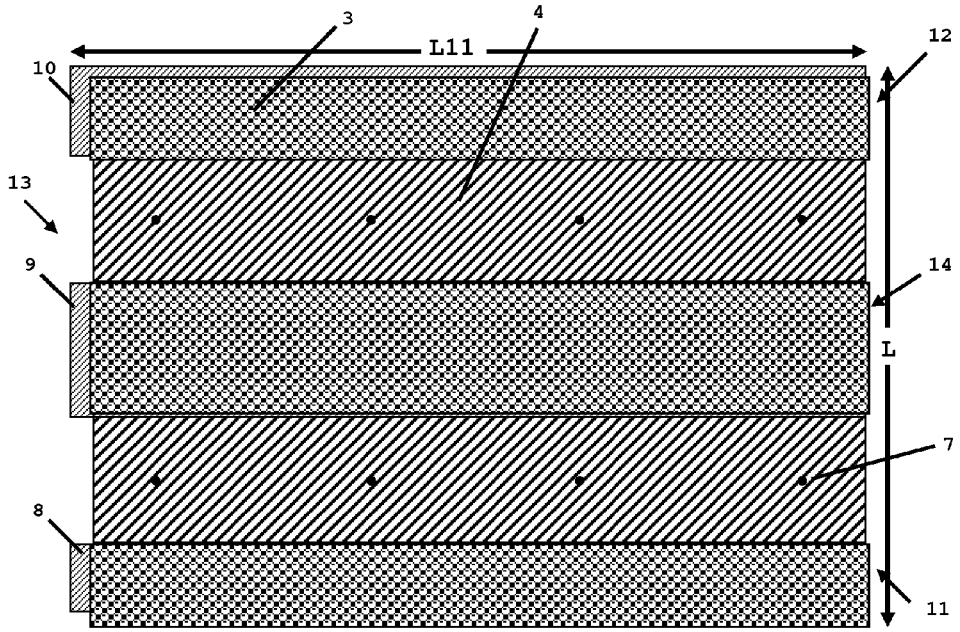
FIG. 9 represents schematically an underside view of the third embodiment of the base flooring section represented in FIG. 3.

The plurality of pads, preferably between 24 and 32 per base flooring section 1, are aligned and periodically spaced to form one row along the length, and at two opposite edges, of the primary deck 2 and to form two rows aligned along the length, and in the middle portion, of the primary deck 2, each rows being parallel (FIGS. 7 and 8). The double row of pads enhances the heavier load resistance of base flooring section 1.

The pads have any suitable hardness, preferably comprised between 45 and 70 durometer, more preferably between 30 and 35 durometer.

In another preferred embodiment, the shock absorption means 3 comprise a least one foam, a urethane-based foam for example, provided along the length and both sides of the subfloor 4 (FIGS. 3 and 6) to improve the acoustic properties of the base flooring section 1 section. The base flooring section 1 may further comprise a least one foam 23 provided above the primary deck 2.

The foam used as shock absorption means 3 and the foam 23 may have either the same thickness or a different thickness. The foam has any suitable indirect load deflection (ILD). Preferably, the foam has a density of around 0.08 pounds per square foot (0.3906 kg/m$^2$).

The shock absorbing means 3 are fastened on the primary deck 2 by any suitable means, either before or after the assembly with the subfloor 4, and as the base flooring section 1 section may be a pre-fabricated flooring, they are preferably fastened during the construction of the base flooring section 1. Preferably, the shock absorbing means 3 are stapled or glued on the primary deck 2.

The primary deck 2 further comprises a subfloor 4 provided under the under side 202 of the primary deck 2 and provided adjacent to the shock absorbing means 3. Preferably, the subfloor 4 is made of two pieces, or panels, running along the length of the primary deck 2 and between three series of shock absorbing means 3. The subfloor 4, or pieces of subfloor 4, is provided higher from the surface to cover than the shock absorbing means 3 allowing thus the subfloor 4, or pieces of subfloor 4, to contact the concrete or slab when the base flooring section 1 is compressed with heavy loads, or heavier loads than the ones in a normal use, e.g. athletic equipments, allowing therefore the base flooring section 1 section to present improved vertical resistance without compromising force reduction during regular use. The difference of height between the subfloor 4 and the shock absorbing means 3 defines a compression space allowing the subfloor 4 to act as "blocking" means whenever a heavy load, or a heavier load than the one in a normal use, is applied to the primary deck 2.

Preferably, the subfloor 4 is made of two wood panels.

The subfloor 4 may further comprise resilient means 5 (FIGS. 4 to 6) which contact the surface to cover when the base flooring sections 1 is installed, and in normal use, offering thus good dimensional stabilization. This improves the issue of "dead spots" common when floor profiles are a concern. When the base flooring section 1 section is laid on the surface to cover, the shock absorption means 3 and the resilient means 5 engage both the concrete and slab.

The resilient means 5 are embedded into and extending outwardly and downwardly from the subfloor 4. The thickness of the subfloor 4 is lower than the overall thickness of the subfloor 4 and the outwardly extending part of resilient means 5. Therefore, the height of the part of resilient means 5 extending outwardly from the subfloor 4 corresponds to compression space of the subfloor 4.

The resilient means 5 are made of any suitable material, for example rubber, foam or other cushioning material.

The resilient means 5 have any suitable softness or hardness. Preferably, their density is chosen taking into account the hardness of the shock absorbing means 3 and the final performance of the base flooring section 1 and the prefabricated flooring system.

In the embodiment wherein the resilient means 5 are made of rubber, their density may be comprised between 30 pounds per cubic foot (480.55 $Kg/m^3$) and 70 pounds per cubic foot (1121.29 $Kg/m^3$).

In a preferred embodiment, the resilient means 5 comprise an insert made of a resilient material surrounded by two pieces of the subfloor 4, preferably two plywood, running adjacent on both sides of said insert.

In another preferred embodiment, the subfloor 4 is made of a one piece and an hollow, or recess, is drilled on its lower surface along its entire length, the insert being installed into the hollowed portion thus formed.

Figure 13:
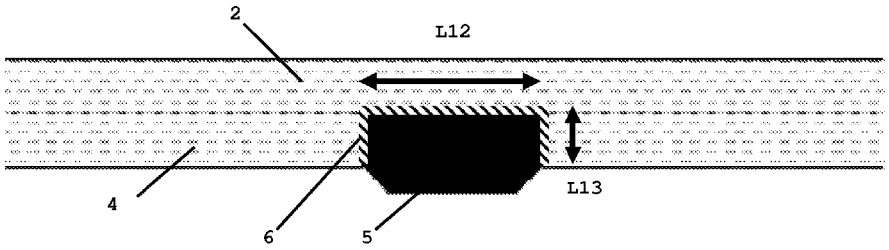
FIG. 13 represents schematically one embodiment of the subfloor of the base flooring section.
Figure 14:
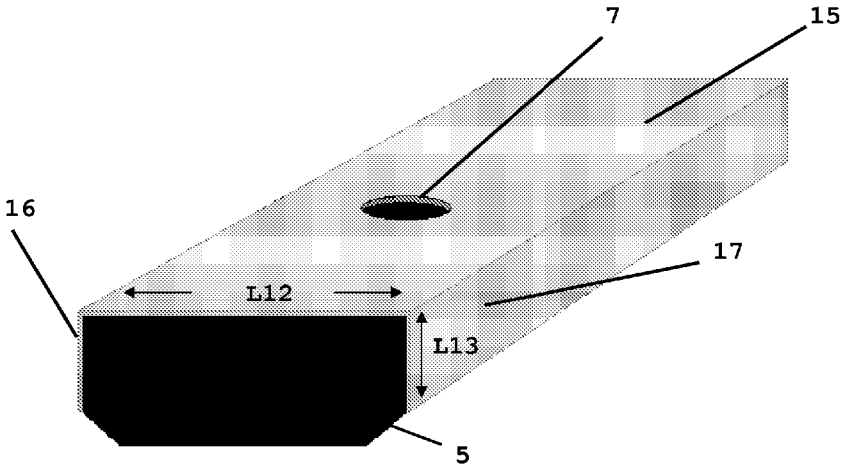
FIG. 14 represents schematically one embodiment of the resilient means of the base flooring.
Figure 15:
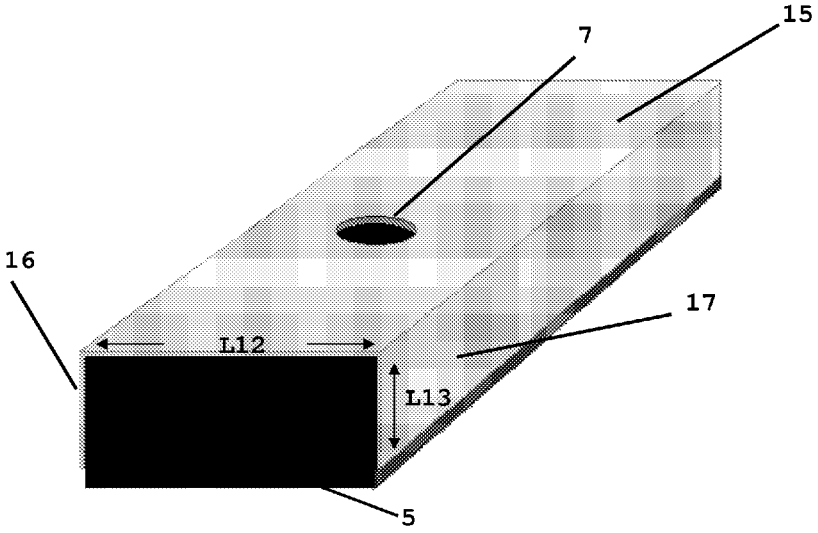
FIG. 15 represents schematically a second embodiment of the resilient means of the base flooring.

In both embodiments, the subfloor 4 may further comprise a continuous channel 6, or rail, comprising an upper section 13 and two generally vertical sidewalls 16 and 17 (FIGS. 13 to 15), the upper section 15 facing the primary deck 2 and the vertical sidewalls 16 and 17 facing the subfloor 4 or the two pieces of the subfloor 4 (FIG. 13). The continuous channel 6 comprises the resilient means 5, i.e. the insert, which faces and contacts the surface to cover. The metal channel 6 has substantially the same shape, substantially the same cross section geometry, as the insert. Preferably, the continuous channel 6 is made of any suitable rigid material, for example made of metal, more preferably made of steel.

The resilient means 5 may be a long strip of rubber running along the length of the subfloor 4 or may comprise a plurality of pieces, or pods, of resilient material having substantially a uniform cross-sectional geometry, for example six to eight 2 inches by 2 inches (5 cm×5 cm) pieces of rubber per base flooring section 1, having a rectangular shape and laid along the length of the subfloor 4.

Figure 10:
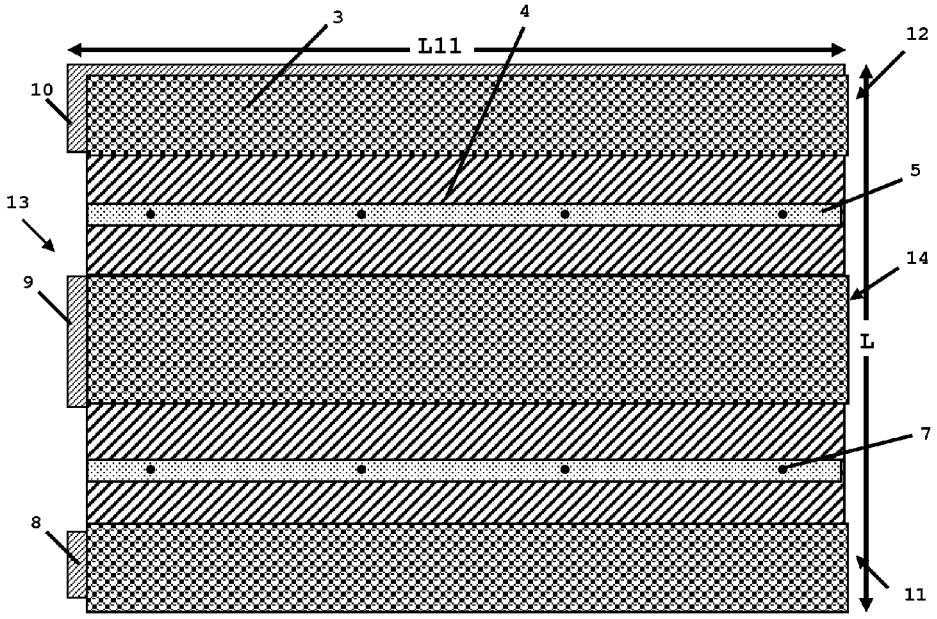
FIG. 10 represents schematically an underside view of the sixth embodiment of the base flooring section represented in FIG. 6.
Figure 11:
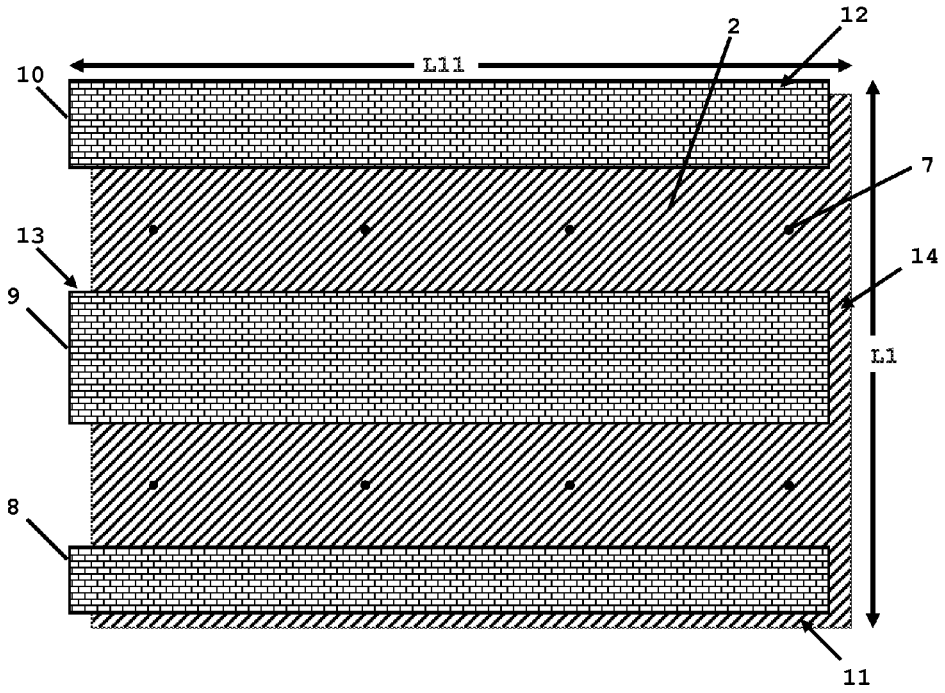
FIG. 11 represents schematically an upperside view of the base flooring section represented in FIG. 1, 2, 4 or 5.
Figure 12:
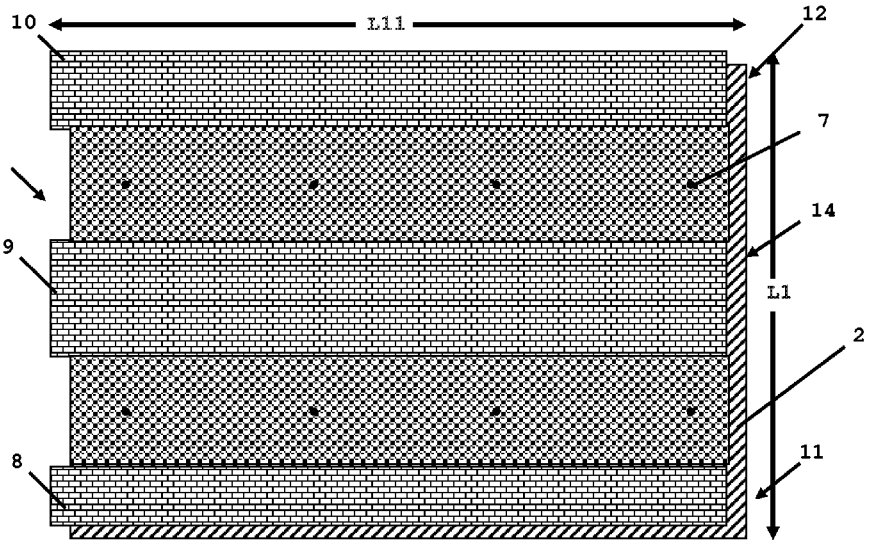
FIG. 12 represents schematically an upperside view of the base flooring section represented in FIG. 3 or 6.

Preferably, the resilient means 5 have a square section and comprise bevel edges on the side being in contact with the surface to cover (FIGS. 10 and 11).

Figure 16:
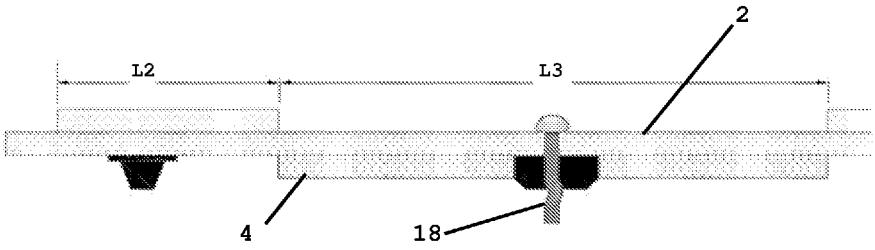
FIG. 16 represents schematically one embodiment of the anchor means of the flooring system.
Figure 17:
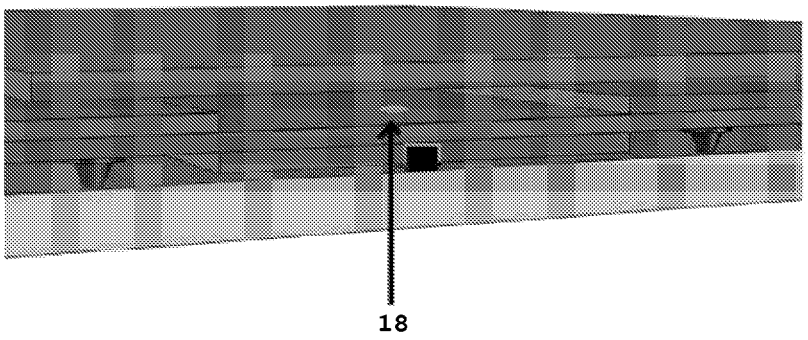
FIG. 17 is a perspective representation of the anchor means of the base flooring section.

The subfloor 4, the resilient means 5, and the continuous channel 6 if present, may further comprise anchoring means 7, which preferably comprise at least one hole, more preferably a plurality of holes, extending through the subfloor 4, the resilient means 5 and the continuous channel 6 if present. The anchoring means 7 further comprise means for cooperating with the hole, for example an anchor pin 18, or a plurality of anchor pins, set from the top of the primary deck 2 through the metal channel 6 if present, and the resilient means 5, i.e. the insert, into the slab or concrete below (FIGS. 16 and 17).

The anchoring means 7 and means for cooperating with said anchoring means 7 are selected so that base flooring section 1 may move vertically to keep the blocking effect provided by the subfloor 4.

The base flooring section 1 further comprises interconnection means to interconnect at least two base flooring sections 1, the means being arranged above the upper side 201 of the primary deck 2. The interconnection means are arranged on at least one edge, preferably two edges, more preferably four edges, and even more preferably on all edges of said base flooring section 1.

The interconnection means of one or several edges from one base flooring unit are complementary to and for cooperation with the interconnection means of at least one edge of the same base flooring unit or of another base flooring unit to form an interconnection junction.

In a preferred embodiment, the interconnection means comprise at least one tongue and at least one groove to form a tongue-groove interconnection junction.

In another preferred embodiment, the interconnection means comprise finger joining type joint portion at two edges, opposite or adjacent, of the base flooring section 1. Preferably, the interconnection means comprise nailing strips aligned parallel and laid above the upper side 201 and along the length of the primary deck 2.

Figure 18:
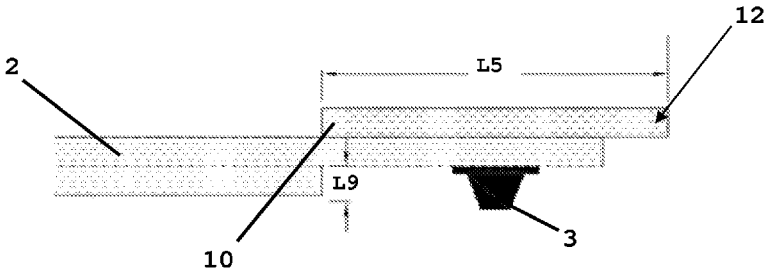
FIG. 18 represents schematically one embodiment of the joint portion of a first edge of the base flooring section.
Figure 19:
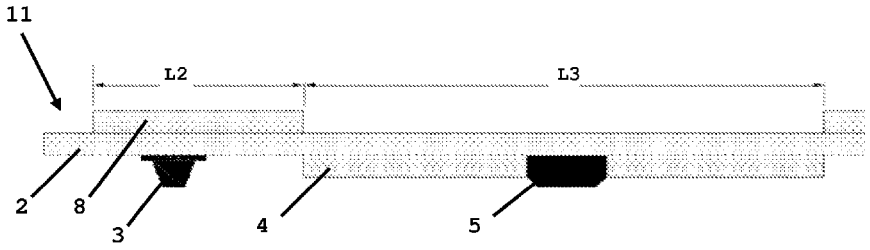
FIG. 19 represents schematically one embodiment of the joint portion of the second edge of the base flooring section.
Figure 20:
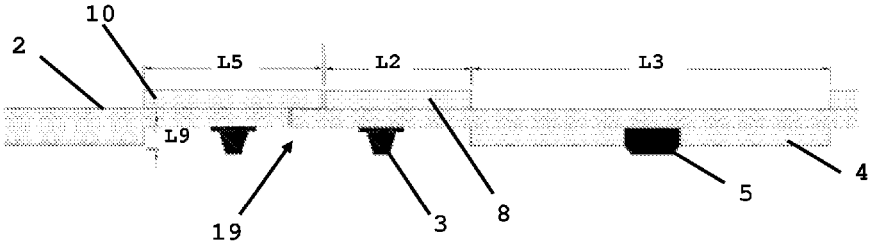
FIG. 20 represents schematically one embodiment of the joint profile of two adjacent base flooring sections.
Figure 21:
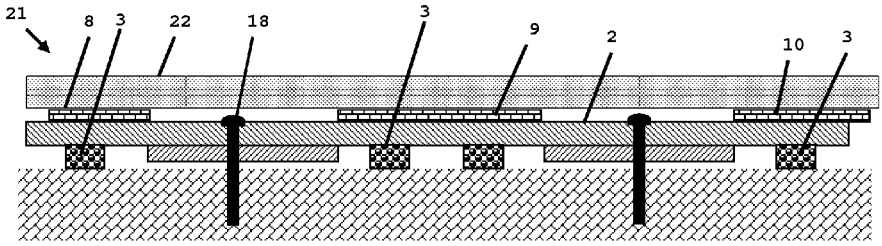
FIG. 21 represents schematically a portion of the flooring system comprising the base flooring represented at FIG. 1 and an upper flooring.
Figure 22:
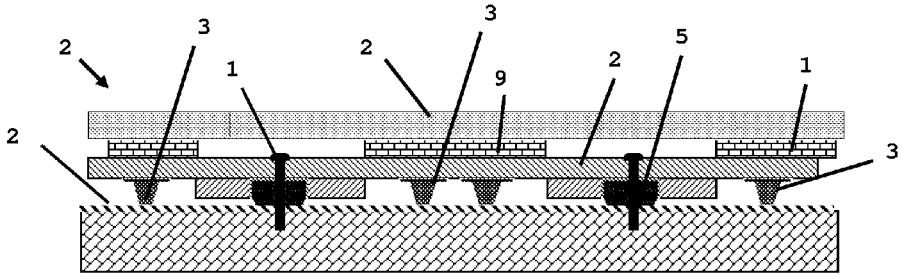
FIG. 22 represents schematically a portion of the flooring system comprising the base flooring represented at FIG. 2 and an upper flooring.
Figure 23:
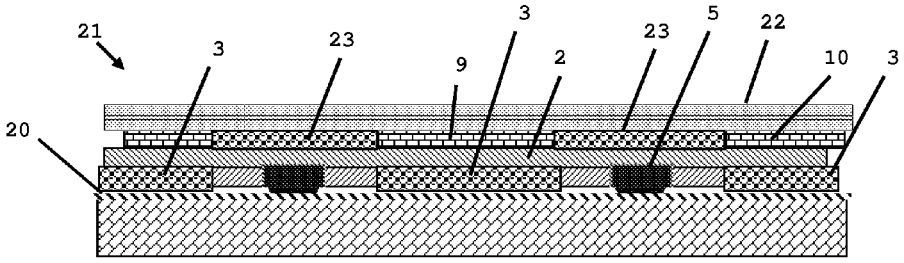
FIG. 23 represents schematically a portion of the flooring system comprising the base flooring represented at FIG. 6 and an upper flooring.
Figure 24:
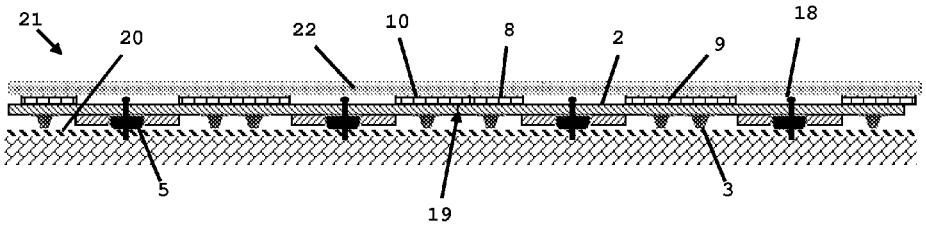
FIG. 24 represents schematically a larger view of the flooring system represented at FIG. 22.

The base flooring section 1 section comprises at least two nailing strips 8 and 10 at opposite edges of the primary deck 2, a nailing strip 8 extending backward (shifted from the edge) and above a first edge to form a joint portion 11 (FIG. 19), the other nailing strip 10 extending outwardly beyond and above a second and opposite edge of the primary deck 2 to form a joint portion 12 (FIG. 18), both junction portions being cooperative. The nailing strips 8 and 10 extending outwardly beyond and above a third edge and extending backward and above a fourth edge, opposite to third edge of the primary deck 2 to form cooperative joint portions 13 and 14 (FIG. 20).

Therefore, a finger joining profile is created on both the length and width of the base flooring section 1 section.

Preferably, the base flooring section 1 section further comprises a third nailing strip 9 arranged above the upper side 201 and substantially at the centre of the primary deck 2 and extending outwardly beyond and above a third edge and extending backward and above a fourth edge opposite to the third edge of the primary deck 2 to form cooperative joint portions 13 and 14.

Preferably, the two nailing strips 8 and 10 are arranged substantially above the shock absorption means 3 at the edges of the primary deck 2 and the third nailing strip 9 is arranged substantially above the shock absorption means 3 at the middle of the primary deck 2 (FIGS. 6 to 12).

The nailing strips 8, 9 and 10 have substantially the same length and same thickness, but may have a different width.

Figure 6:
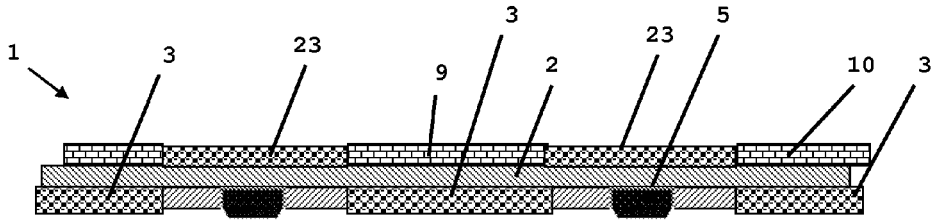
FIG. 6 represents schematically a sixth embodiment of the base flooring section according to the invention.

Preferably, the base flooring section 1 further comprises shock absorption means 3 above the primary deck 2, preferably a least one foam 23 running continuous down the length, and on both sides, of the nailing strip 9 (FIG. 6).

The joint portions 11 (FIG. 19) and 12 (FIG. 18) of a base flooring section 1 cooperate with the joint portions 12 and 11 respectively of a second base flooring section 1 unit to form a interconnection junction 19 represented at FIG. 20, to joint two adjacent base flooring section 1 units. In the same manner, the joint portions 13 and 14 cooperate with the joint portions 14 and 13 respectively of a second base flooring section 1 unit to joint two adjacent base flooring section 1 units. Preferably, a 0.25 inch (0.6 cm) gap is kept between each panel around the perimeter. This gap presents the advantage of preventing or reducing the noise created by the joints portion rubbing together when deflected under load, and offers a small measure of expansion or contraction control.

The interconnection junctions then provided are fastened by any suitable means, preferably by nails.

As an example, the base flooring section 1 is made of wood, more particularly of plywood panels, and have a rectangular shape. The overall width L is around four feet (1.22 m) and two inches (5 cm) and the overall length L11 is around eight feet (2.44 m) and two inches (5 cm). The primary deck 2 has a width L1 of around four feet (1.22 m) for a length of around eight feet (2.44 m) and a thickness L7 of ½ inches (1.27 cm). Affixed onto the primary deck 2, there are three nailing strips 8, 9 and 10 of around ninety six inches (2.44 m) long and around 15⁄32 inches (11 mm) thick (L8) plywood, the nailing strip 8, shifted onto the primary deck 2, being of around four inches (10.16 cm) wide (L2), the nailing strip 9 on the middle being of around twelve inches (30.48 cm) wide (L4), the nailing strip 10 extending beyond the primary deck 2 being of around eight inches (20.32 cm) wide (L5) and extending of a distance L6 of around two inches (5 cm) to form joint portion 12. All the nailing strips arranged at the edges of the primary desk are separated by a distance L3 of around one foot (0.3 m) from the nailing strip arranged at the middle of said primary desk 2. All the nailing strips are shifted from the primary deck 2 from about four inches (10.20 cm) to form joint portions 13 and 14. The shock absorption means 3 have a height L10 of around ¾ inches (19 mm) and a width of around two inches (5 cm) for length of around 2 inches (5 cm). For a primary deck 2 of four feet (1.22 m) per eight feet (2.44 m), each row of absorption means 3 comprises eight pads periodically spaced of around twelve inches (30.5 cm) (L15), and provided at a distance L14 and L18 from the primary deck 2 edges of six inches (15.2 cm) and at a distance L16 and L17 from the subfloor 4 edges of 3 inches (7.6 cm). The subfloor 4 has a thickness L9 of around ½ inch (1.27 cm). For the embodiments comprising a continuous channel 6, said channel has a width L12 of around two inches (5 cm) and a height L13 of around ½ inch (1.27 cm).

The flooring system 21 according to the invention has at least one base flooring section 1, preferably a plurality of base flooring sections 1, preferably prefabricated, and arranged generally side-by-side and end-to-end, laid down onto the floor, or preferably onto a vapour retarder layer 20 covering the concrete or slab for preventing moisture from below the slab, the flooring system 21 further comprising an upper flooring 22 to provide a continuous flooring (FIGS. 21 to 24).

The upper flooring 22 is any suitable flooring, preferably a wood flooring made of several panels interconnected, preferably disposed perpendicular to the base flooring sections.

In a preferred embodiment, the upper flooring 22 comprises ¾ inch (19 mm) thick and 2.25 inches wide (57 mm) panels their length being randomly distributed.

The plurality of base flooring sections 1, and thus the flooring system 21 according to the invention, can be installed as a floating system. However, it can also be installed as a fixed system, using anchoring means 7 cooperating with anchor pins 18, a system with a reduction or elimination of moving parts, each base flooring section 1 being attached to adjacent base floorings by the interconnection junctions, providing thus an overall dimensional stability without compromising a high level of performance.

The flooring system 21 according to the invention accommodates game performances and the handling of typical fixed bleacher assemblies and portable athletic equipment or apparatus.

The performances of the flooring system 21 according to different embodiments of the invention were tested according to EN 14904 (2006). In particular, were tested the force reduction, being the flooring system's ability to absorb impact forces generated by a user, the ball rebound, being the response of the system compared to the ball's rebound response of concrete, the vertical deflection, being the floor system's downward movement during the impact of a user (player) landing on the surface, and the indentation indicating how well vibrations are contained by the system. The results are summarized in table 1.

TABLE 1

Performances of the flooring system.

| Embodiments | Force reduction | Ball rebound | Vertical deflection | Area indentation |
|---|---|---|---|---|
| 1 | 52% | 101% | 1.7 mm | 9% |
| 2 | 56% | 101% | 1.9 mm | 10% |
| 3 | 53% | 101% | 1.8 mm | 10% |
| 4 | 53% | 101% | 1.7 mm | 10% |

The embodiment n °1 corresponds to a eight feet (2.44 m) per four feet (1.22 m) base flooring section 1 represented in FIG. 5, comprising shock absorption means 3 in the form of four rows of seventy durometer pads provided along the length and at two opposite edges of the primary deck 2 and two rows of pads aligned parallel along the length of the primary deck 2. The subfloor 4 comprises two plywood panels, running adjacent on both sides of a continuous channel 6 made of steel and comprising a continuous rubber insert.

The embodiment n °2 is the same as the embodiment n °1 except the fact that the subfloor 4 comprises a continuous rubber insert and no continuous channel 6.

The embodiment n °3 is the same as the embodiment n °1 except the fact that the continuous channel 6 comprises rubber pod inserts.

The embodiment n °4 is the same as the embodiment n °3 except the fact that the subfloor 4 does not comprise a continuous channel 6.

From table 1, it appears that the ball bounce results are quite uniform for all the embodiments tested. For all the embodiments, the ball bounce is around 101%, meaning very good ball play, this probably due to less dead spots in the flooring system.

Regarding vertical deflection, it appears that all the base flooring section 1 tested, with or without a continuous channel 6, present greatly reduced vibration. The embodiments comprising a continuous insert present a slightly better performance.

The invention claimed is:

1. A shock absorbing base flooring section comprising:

a primary deck comprising an upper side and an under side; interconnection means to interconnect at least two base flooring section, said interconnection means being arranged above said of said of said primary deck;

shock absorption means attached under said under said of said primary deck; and a subfloor, attached under said primary deck and provided between the shock absorbing means, said subfloor having a thickness lower than the height (L10) of said shock absorption means;

wherein: said interconnection means comprise strips arranged above said upper side of said primary deck, said strips being laterally spaced from one another and extending over the length of said primary deck; said subfloor is arranged under said primary deck, so as to extend between said strips; and said shock absorption means are arranged under said under side of said primary deck, where the upper side of said primary deck is equipped with said strips.

2. The shock absorbing base flooring section according to claim 1, further comprising resilient means embedded in, extending outwardly and downwardly from, the subfloor the absorption means and said resilient means being arranged to contact simultaneously, in use, a surface to cover in the same plane.

3. The shock absorbing base flooring section according to claim 1, wherein the resilient means are arranged into a downwardly facing continuous channel.

4. The shock absorbing base flooring section according to claim 1, wherein the subfloor is made a two panels running along the length of the primary deck and between three series of shock absorbing means, the first and second series being provided at two opposite edges of said primary deck and the third series provided in the middle portion of said primary deck.

5. The shock absorbing base flooring section according to claim 1, wherein the shock absorption means comprise a plurality of pads aligned and periodically spaced along the length of the primary deck in a plurality of parallel rows, two of said rows arranged at two opposite edges of said primary deck and two rows arranged in the middle portion of said primary deck.

6. The shock absorbing base flooring section according to claim 5, wherein the pads have a hardness comprised between 45 and 70 durometer.

7. The shock absorbing base flooring section according to claim 1, wherein the shock absorption means comprise a least one foam provided along the length and both side of the subfloor.

8. The shock absorbing base flooring section according to claim 1, further comprising anchoring means to affix said base flooring section to the surface to cover.

9. The shock absorbing base flooring section according to claim 1, wherein the interconnection means comprise a first and a second nailing strip at a first and second opposite edges of the primary deck, the first nailing strip extending backward and above said first edge to form a joint portion, the second nailing strip extending outwardly beyond and above said second edge to form a joint portion, both joint portions being cooperative to each other.

10. The shock absorbing base flooring section according to claim 9, wherein the interconnection means comprise a third nailing strip arranged above and substantially at the centre of the primary deck and extending outwardly beyond and above a third edge and extending backward and above a four edge, opposite to third edge of said primary deck to form cooperative joint portions.

11. The shock absorbing base flooring section according to claim 1 being made of wood.

12. A prefabricated flooring system comprising at least two interconnected shock absorbing base flooring section according to claim 1 and an upper flooring.

13. The prefabricated flooring system according to claim 12 being a sport flooring.

* * * * *

UNITED STATES PATENT AND TRADEMARK OFFICE

CERTIFICATE OF CORRECTION

PATENT NO. : 8,931,226 B2
APPLICATION NO. : 13/698203
DATED : January 13, 2015
INVENTOR(S) : William Thornton It is certified that error appears in the above-identified patent and that said Letters Patent is hereby corrected as shown below:

In the Claims

Column 8, line 61, claim 1, --upper side-- should be inserted after --above said--

Signed and Sealed this
Twenty-sixth Day of May, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,931,226 B2
APPLICATION NO. : 13/698203
DATED : January 13, 2015
INVENTOR(S) : William Thornton It is certified that error appears in the above-identified patent and that said Letters Patent is hereby corrected as shown below:

In the Claims
Column 8, line 61, claim 1, after "arranged above said" delete "of said" and insert --upper side--;
Column 8, line 62, claim 1, after "absorption means attached under said under" delete "said" and insert --side--.

Signed and Sealed this
Tenth Day of November, 2015

Michelle K. Lee

Michelle K. Lee
*Director of the United States Patent and Trademark Office*